US008943710B2

(12) United States Patent
von Mettenheim

(10) Patent No.: US 8,943,710 B2
(45) Date of Patent: Feb. 3, 2015

(54) PEDICURE PROTECTION DEVICE AND SYSTEM

(71) Applicant: Barbara von Mettenheim, Alexandria, VA (US)

(72) Inventor: Barbara von Mettenheim, Alexandria, VA (US)

(73) Assignee: BvonM, LLC, Alexandria, VA (US)

( * ) Notice: Subject to any disclaimer, the term of this patent is extended or adjusted under 35 U.S.C. 154(b) by 220 days.

(21) Appl. No.: 13/687,547

(22) Filed: Nov. 28, 2012

(65) Prior Publication Data

US 2014/0144047 A1 May 29, 2014

(51) Int. Cl.

| | |
|---|---|
| ***A43B 3/12*** | (2006.01) |
| ***A43B 3/10*** | (2006.01) |
| ***A43B 3/16*** | (2006.01) |

(52) U.S. Cl.

CPC . *A43B 3/101* (2013.01); *A43B 3/12* (2013.01); *A43B 3/163* (2013.01)

USPC ..... 36/77 R; 36/72 R; 36/11.5

(58) Field of Classification Search

CPC ..... A43B 3/24; A43B 23/08; A43C 13/14

USPC ..... 36/77 R, 72 R, 11.5, 100, 101

See application file for complete search history.

(56) References Cited

U.S. PATENT DOCUMENTS

| | | | | |
|---|---|---|---|---|
| 1,890,433 | A * | 12/1932 | Cohen | 36/3 A |
| 4,366,633 | A * | 1/1983 | Flottorp | 36/101 |
| 4,995,174 | A * | 2/1991 | Hong et al. | 36/72 R |
| 5,926,978 | A * | 7/1999 | Smith | 36/101 |
| 5,946,823 | A * | 9/1999 | Yates | 36/11.5 |
| 6,836,980 | B2 * | 1/2005 | Woods | 36/110 |
| 7,134,225 | B2 | 11/2006 | Ashton | |
| 7,296,367 | B2 | 11/2007 | Kipnes | |
| 7,340,852 | B1 | 3/2008 | Tai | |
| 7,421,807 | B2 | 9/2008 | Condie | |
| 7,681,332 | B2 * | 3/2010 | Allen | 36/94 |
| 7,802,381 | B2 | 9/2010 | Condie | |
| 2003/0213149 | A1 * | 11/2003 | Woods | 36/110 |
| 2006/0064902 | A1 * | 3/2006 | Ashton | 36/72 R |
| 2006/0230637 | A1 * | 10/2006 | Kipnes | 36/94 |
| 2007/0011915 | A1 | 1/2007 | Allen | |
| 2007/0017126 | A1 * | 1/2007 | Kipnes et al. | 36/101 |
| 2007/0068045 | A1 | 3/2007 | Condie | |
| 2007/0130802 | A1 | 6/2007 | Condie | |
| 2007/0214681 | A1 * | 9/2007 | Dezfouli | 36/101 |
| 2008/0052959 | A1 * | 3/2008 | Hu | 36/42 |
| 2009/0229145 | A1 * | 9/2009 | Ortner | 36/100 |
| 2010/0263237 | A1 * | 10/2010 | Cuellar et al. | 36/136 |

* cited by examiner

*Primary Examiner* — Marie Bays
(74) *Attorney, Agent, or Firm* — Todd L. Juneau

(57) ABSTRACT

This invention relates a cover for freshly pedicured toes that is designed for reusable, temporary attachment to and detachment from commercially available, open-toed shoes, sandals or slippers, and a system and method of use comprising such cover.

6 Claims, 7 Drawing Sheets

PEDICURE PROTECTION DEVICE AND SYSTEM

CROSS REFERENCE TO RELATED APPLICATIONS

Not applicable.

STATEMENT REGARDING FEDERALLY SPONSORED RESEARCH OR DEVELOPMENT

No federal government funds were used in researching or developing this invention.

NAMES OF PARTIES TO A JOINT RESEARCH AGREEMENT

Not applicable.

SEQUENCE LISTING INCLUDED AND INCORPORATED BY REFERENCE HEREIN

Not applicable.

BACKGROUND

FIELD OF THE INVENTION

Pedicures, including the application of wet polish to the toe nails, are a common grooming practice, especially among women and girls. After application, many commercially available nail polishes may take an hour or more to fully dry, and are subject to scratching, marking and smearing during that time.

Pedicures are often self-performed at home, or by professional nail technicians in spas or nail salons. Materials or objects coming into contact with nail polish before it is fully dried are subject to being temporarily or permanently marred by the polish, and the painted nails themselves are subject to be smeared, scratched or marked during such period. This fact causes a problem for pedicure wearers who need to perform activities during the drying period. Driving poses an especially daunting challenge. While the use of open-toed footware, such as thongs, in combination cotton balls or other toe-dividing devices provides some protection, these solutions leave the toes open to contact with outside objects should the wearer's attention flag for even a moment.

Another device available to pedicure wearers are certain types of shoes and boots designed specifically to cover fresh pedicures, or even to encapsulate entire pedicure sandals. Disclosures of full shoes and slippers for protecting pedicures are disclosed in the prior art. Notably, U.S. Pat. Nos. 7,802,381 and 7,421,807 to Condie; U.S. Pat. No. 7,340,852 to Tai; U.S. Pat. No. 7,296,367 to Kipnes; U.S. Pat. No. 7,134,225 to Ashton and U.S. Pat. No. 5,946,823 to Yates disclose footware designed to prevent the smearing of wet nail polish.

Use of a shoe or slipper specifically designed for pedicure protection is less than ideal for the user, as it involves the purchase, transportation and storage of an additional pair of shoes with an extremely limited period of utility. An average person is likely to receive a pedicure only once or twice a month, meaning the pedicure shoes need only be worn for an hour or two during the month. Despite this fact, a full pedicure shoe is likely to have a cost similar to other shoes. While not in use, the pedicure shoes take up closet space. Additionally, when a pedicure is performed at a salon or spa, many wearers will face the inconvenience of having to carry either the pedicure shoes or their more stylish and/or comfortable, normal shoes while en route.

What is needed is a casing or cover for the toes during the time immediately following a pedicure procedure, which can be attached to the wearer's open-toed shoe or sandal, then conveniently removed and stored after the nail polish has dried.

BACKGROUND OF THE INVENTION

The current state of knowledge is as follows.

This invention relates a cover for freshly pedicured toes that is designed for temporary, repeated attachment to and detachment from commercially available, open-toed shoes, sandals or slippers, and a system comprising such cover. Such invention comprises a plastic, injection molded cover which, in some embodiments, comprises a sole with a molded-in notch for overlaying a thong strap, and/or built-in clips for attachment to the straps of commercially available footware such that the cover can be attached to and detached from the wearer's own footware during the drying period immediately following a pedicure.

The invention also relates to a protection system whereby separate points of attachment are provided together with the cover, which points of attachment can be adhered to various locations on a piece of footware such that the cover may be attached and detached. Such points of attachment may include devices such as magnets or other fastening material, which correspond to similar points comprised within or adhered to the cover itself. In one embodiment, the points of attachment are adhered to the footware using pressure-sensitive adhesive which can be easily removed should the wearer no longer wish to use a certain shoe or sandal with the protection system.

BRIEF SUMMARY OF THE INVENTION

The novel components of this work are the simple design which allows for inexpensive device production and ease of device attachment, detachment and storage. A reusable protector cover for toes is provided such that the toe cover will temporarily attach to and detach from a standard, commercially available open-toed shoe or sandal.

In a preferred embodiment is provided a toe cover in the shape of a shoe vamp, comprising a means of attachment to the top, front and/or outer sole of a shoe, sandal or slipper.

In another preferred embodiment, the disclosed toe cover, further comprising one or more ventilation holes.

In another preferred embodiment, the disclosed toe cover, further comprising wherein the one or more ventilation holes are shaped as elongated vertical slits.

In another preferred embodiment, the disclosed toe cover, further comprising wherein the material of the cover is a polymer taken from the group comprising, without limitation, polyethylene, polypropylene, PVC and other vinyls, PVBs, synthetic rubber and Bakelite, as well as any other appropriate polymer known in the art.

In another preferred embodiment, the disclosed toe cover, further comprising a sole component.

In another preferred embodiment, the disclosed toe cover, further comprising wherein the means of attachment is a connection notch is molded into the sole component, which connection notch is configured to slide around the front portion of the strap of a thong-type sandal.

In another preferred embodiment, the disclosed toe cover, further comprising wherein the forward end of the connection notch narrows, which narrow portion terminates in a lumen of sufficient diameter to accommodate the front portion of a strap of a thong-type sandal.

In another preferred embodiment, the disclosed toe cover, further comprising wherein the connection notch comprises more than one lumen, each lumen separated by a narrow channel, to allow adjustable positioning of the toe cover over the underlying sandal.

In another preferred embodiment, the disclosed toe cover, further comprising wherein the means of attachment is one or more clips molded into the cover design, which clips removably fasten to the front strap(s) of a sandal.

In another preferred embodiment, the disclosed toe cover, further comprising wherein the clip(s) act as hinge(s).

In another preferred embodiment, the disclosed toe cover, further comprising a tab molded into the front edge of the cover design for grasping the cover.

In another preferred embodiment, the disclosed toe cover, further comprising wherein the cover is sized to fit standard sizes of commercially available footware.

In a preferred embodiment, pedicure protection system comprising the disclosed toe cover, further comprising one or more devices adhered to the toe cover constituting points of attachment and overlapping device(s) adhered to a shoe or sandal constituting correlating points of attachment.

In another preferred embodiment, the disclosed pedicure protection system, further comprising wherein the means of attachment is one or more magnets and/or metal tabs adhered to the underside of the top and/or side ridges of the toe cover and corresponding magnets and/or metal tabs adhered to the top and/or sides of the soles of the shoe or sandal.

In another preferred embodiment, the disclosed pedicure protection system, further comprising wherein the magnets are rare earth magnets.

In another preferred embodiment, the disclosed pedicure protection system, further comprising wherein recesses matching the depth and shape of the magnets are molded into the underside of the toe cover for placement of the magnets.

In another preferred embodiment, the disclosed pedicure protection system, further comprising wherein the means of attachment is one or more pieces of fastening material adhered to the underside of the top and/or side ridges of the toe cover and corresponding pieces of fastening material adhered to the top and/or sides of the soles of the shoe or sandal.

In another preferred embodiment, the disclosed pedicure protection system, further comprising wherein the fastening material is hook-and-loop fasting material.

In another preferred embodiment, the disclosed pedicure protection system, further comprising wherein the adhesive is pressure-sensitive at higher peeling angles, and is thus removable.

In another embodiment, a method of use of the disclosed toe cover, wherein the cover is attached to and/or detached from commercially available footware via (i) clips molded into the cover body or (ii) via corresponding points of attachment adhered to the cover and the underlying footware, wherein the toe cover is removably attached to the underlying footware via the points of attachment.

DETAILED DESCRIPTION OF THE INVENTION

Definitions

The following definitions are provided as an aid to understanding the detailed description of the present invention.

"Injection molding" means a manufacturing process for producing parts from both thermoplastic and thermosetting plastic or other materials including metals, glasses, elastomers and confections. Material is fed into a heated barrel, mixed, and forced into a mold cavity where it cools and hardens to the configuration of the cavity "Vamp" means the upper front portion of a boot or shoe.

Device Molding

The protective toe cover will preferably be made of plastic. The use of injection molding as a manufacturing process will allow the use of thermoplastic or thermosetting plastic to create a single-component device containing a variety of features for purposes of ventilation, attachment and handling. The injection-molding process will allow these features to be comprised in a single component without the need to fit multiple pieces together.

The toe cover is intended to be used with commercially available, off-the-rack footware. The cover may be manufactured in sizes specifically designed to mirror the standard sizing of shoes in the U.S. or other commercial markets.

The shaping of the toe cover will follow a typical vamp design, but will a greater than normal height to ensure that the cover does not come into contact with the toenails. The cover will also likely comprise one or more openings for ventilation to facilitate drying of the nail polish.

Features

The drying process for wet nail polish is facilitated by constant contact between the polish material and fresh air. The placement of ventilation holes in the protective toe cover is therefore a useful feature to aid the polish in drying more quickly and more evenly. In a preferred embodiment, a plurality ventilation holes shaped as vertical slits are molded into the toe cover to allow free movement of outside air into and out of the cover.

Figure 5:
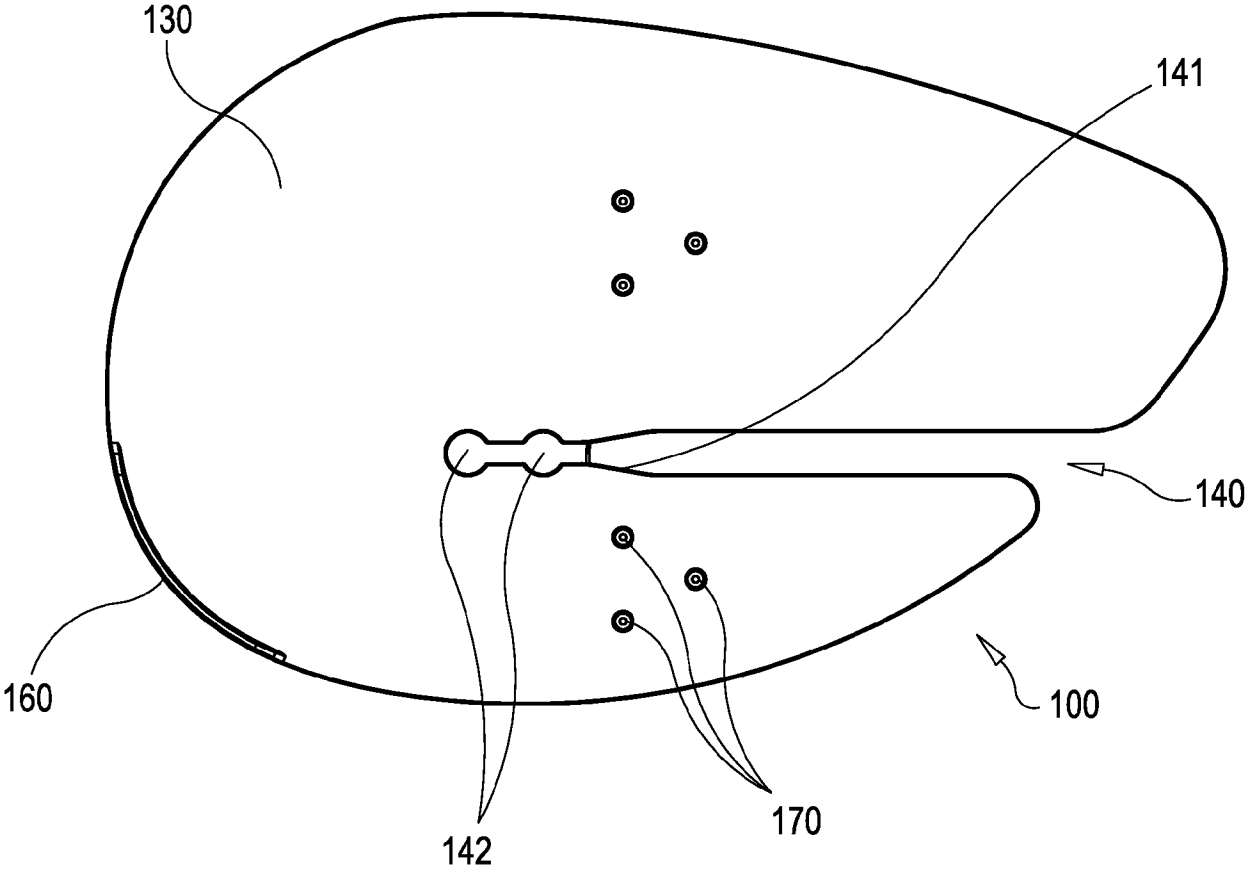
FIG. 5 is a line drawing evidencing a bottom view of the first embodiment of the toe cover.

In one embodiment, the protective toe cover is manufactured and marketed as a free-standing device and comprises a sole component shaped to overlay a thong-style sandal. The sole component is molded to comprise a notch opening rearward, which notch may be pulled over the front part of the thong strap, where the strap extends between the wearer's big toe and second toe, and then through the sole of the sandal. The forward end of the notch narrows before broadening into a circular tip, thus forming a clipping mechanism to prevent the toe cover from shifting positions on the sandal. In another preferred embodiment, more than one circular opening may proceed in succession after the narrowing point of the notch, thus enabling the wearer multiple options for positioning of the cover, as shown in FIG. 5.

In any embodiment comprising a sole component, it will be possible to mold one or more bumps or similar emanations from the underside of the sole component to provide stabilization against slippage between the sole component and the underlying sandal.

In another embodiment, also free-standing device, the toe cover is manufactured with one or more clips molded on the rearward-facing edge for attachment to the front strap(s) of a sandal, slipper or thong of the wearer's choice. In one such embodiment, the clip(s) are molded to circumnavigate the strap(s), allowing the clips to operate as hinges, whereby the toe cover may be flipped up and down without detaching the cover from the underlying sandal, slipper or thong, as shown in FIG. 6. Such clips may be designed with small tabs or emanations allowing the wearer to pinch the tabs for opening and release the tabs for closing. Another possible design would be a molded clip with a rounded tip comprising a permanent opening with a gauge narrow enough to allow the wearer to push the footware strap through such opening, but wherein the strap would only be released when pulled out by the wearer.

In another embodiment, the toe cover serves as a component of a pedicure protective cover system. In this embodiment, instead of or in addition to clips for attachment to a strap of a sandal, slipper or thong, the cover will comprise other points of attachment such as magnets, Velcro® or similar components that require complimentary components on the underlying footware. The system would comprise each of the cover, the attachment devices to be adhered to the cover, either during the manufacturing process or by the wearer after purchase, as well as separate complimentary attachment devices to be adhered by the purchaser to her own shoe or sandal. By way of example and not of limitation, such separate complimentary attachment devices could include Velcro® tape, either in a single strip or multiple, smaller pieces, or magnets with adhesive backing. In either such event, each such piece of tape or magnet would have a removable back which would be pulled away by the purchaser immediately prior to affixing such tape or magnet to the correct placement point on the piece of footware to be utilized.

Materials

In a preferred embodiment, the body of the protective toe cover will be manufactured from a commercially available plastic. Types of plastic used for toe cover construction may be taken from the group comprising, without limitation, polyethylene, polypropylene, PVC and other vinyls, PVBs, synthetic rubber and Bakelite, as well as any other appropriate polymer known in the art.

A preferred method of attachment of the protective toe cover to an underlying shoe or sandal is via magnets. In the present invention, one or more magnets would be adhered to the edges of the underside of the cover itself, probably at regular intervals, and one or more complimentary magnets would be adhered to a shoe or sandal of the wearer's choice. In such a system, shapes of magnets comprised within the invention may be chosen from the group including, without limitation: circular, square, rectangular, or triangular.

The magnets themselves may be chosen from a variety of types, including but not limited to magnetic metals from the group comprising iron, aluminum, cobalt, nickel or rare earth metals. Alternatively, the magnets may be chosen from the group comprising any commercially available composite or synthetic magnets such as ceramics (ferrite), alnico, injection-molded magnets or flexible magnets.

Another method of attachment of the protective toe cover to the underlying shoe or sandal is via a fastening material adhered to the edges of the underside of the cover, with complimentary material adhered to the top and/or sides of the shoe or sandal. In a more preferred example, the fastening material could consist of hook-and-loop fastener material, such as Velcro®. Such material could be configured as strips, or smaller pieces attached at regular intervals.

Magnets, fastening material or other points of attachment may be adhered to the cover and underlying footware by any known commercial adhesive. By way of example and not limitation, such adhesive may be taken from the group comprised of cryanoacrylate, polyurethane, basting glue or thermoplastic adhesive.

In a preferred embodiment, the adhesive used is pressure-sensitive at higher peeling angles, and is thus removable. Pressure-sensitive adhesives suitable for application to one side of the backing and/or the other in the tapes, magnets or other removable points of attachments of the invention system include tackified rubber adhesives, such as natural rubber; olefins; silicones; synthetic rubber adhesives such as polyisoprene, polybutadiene, and styrene-isoprene-styrene, styrene-ethylene-butylene-styrene and styrene-butadiene-styrene block copolymers, and other synthetic elastomers; and tackified or untackified acrylic adhesives such as copolymers of isootylacrylate and acrylic acid, which can be polymerized by radiation, solution, suspension, or emulsion techniques. Preferred are synthetic rubber adhesives or acrylics.

The thickness of each adhesive layer can range from about 0.65 mils to about 50 mils (about 0.0175 to about 1.25 mm), preferably from about 1 mils to about 16 mils (about 0.25 to about 0.41 mm). In this preferred range of thickness, the thicker layers tend to cause the points of attachment to be more easily removable than do thinner layers.

The use of pressure-sensitive, removable points of attachment in the pedicure protection system will allow the wearer to remove the points of attachment and return the underlying footware to standard use without evidence that the toe cover had ever been attached.

Detailed Figures Descriptions

Figure 1:
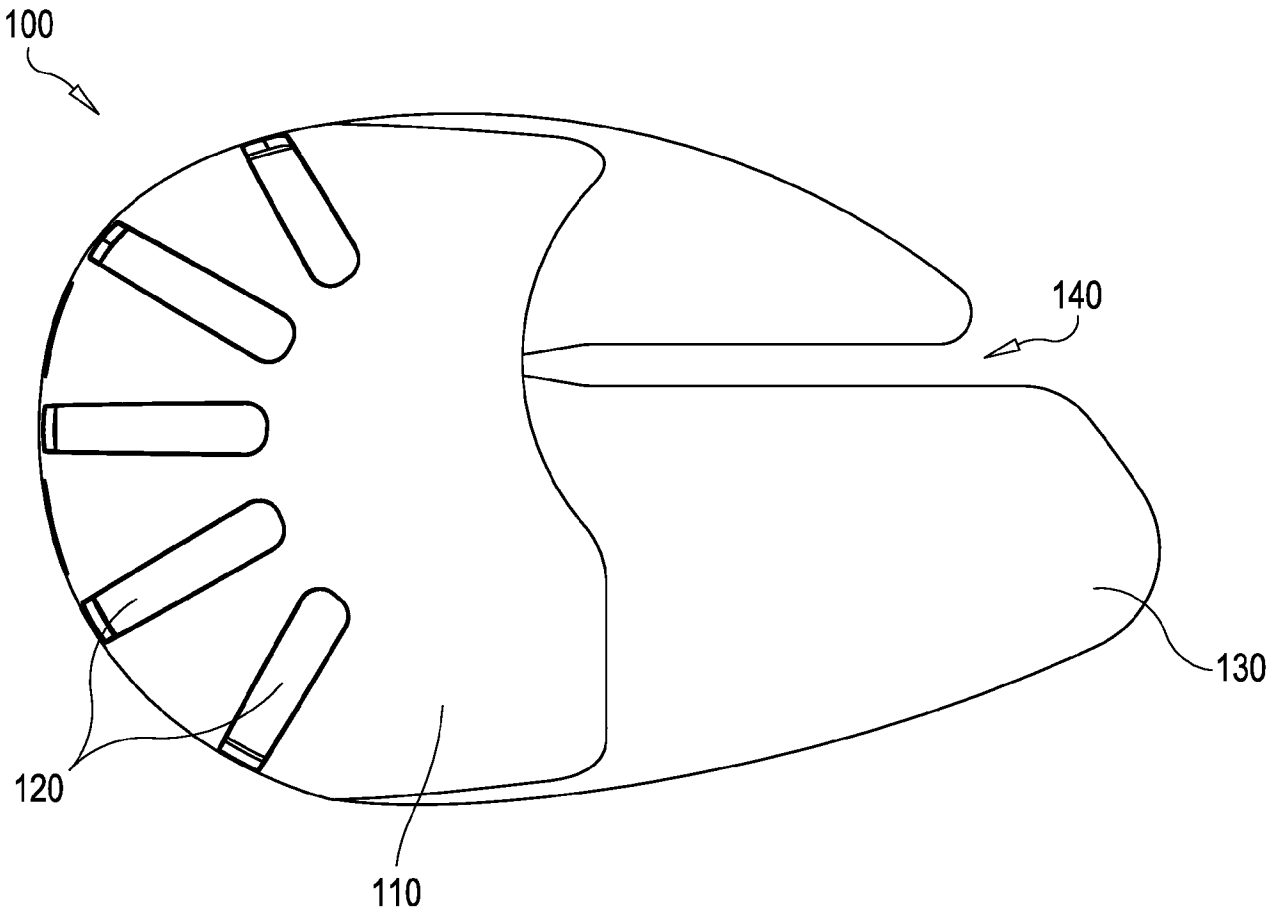
FIG. 1 is a line drawing evidencing a top view of a first embodiment of the toe cover.

Referring now to the Figures, FIG. 1 is a line drawing evidencing a top view of one enablement of pedicure protection system 100. In FIG. 1, toe cover 110 extends upward and backward from the front (left) edge of the single molded component and comprises ventilation slits 120. Sole component 130 extends straight back from the forward edge and comprises connection notch 140, which opens at the back (right) edge.

Figure 2:
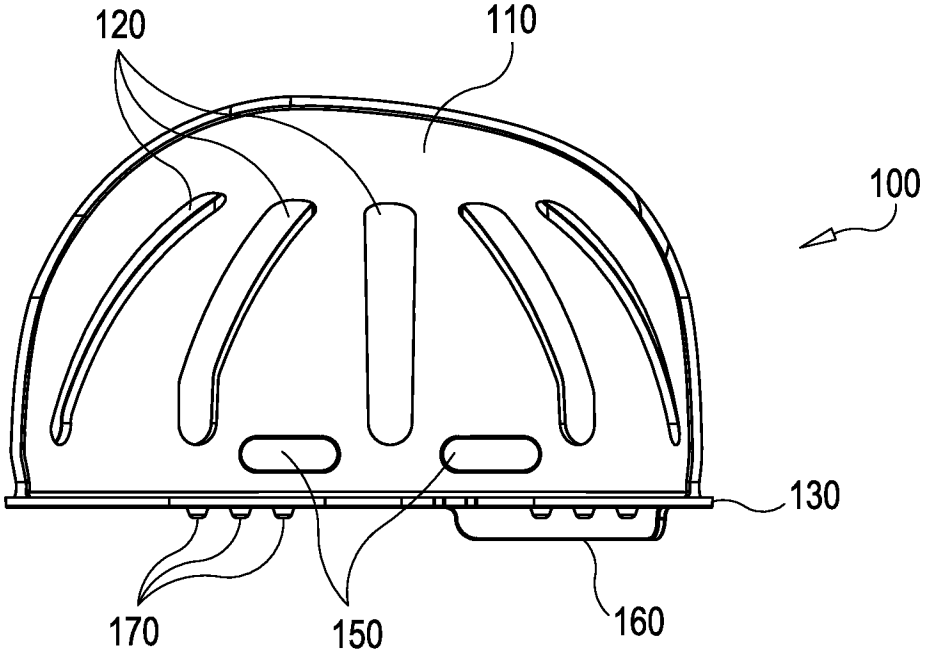
FIG. 2 is a line drawing evidencing a front view of the first embodiment of the toe cover.

FIG. 2 is a line drawing evidencing a front view of the enablement of pedicure protection system 100, as pictured in FIG. 1. In this drawing, the sole component 130 appears flat and the toe cover 110 extends upward, comprising ventilation slits 120 and two forward-facing ventilation holes 150. Grasping tab 160 extends downward from the front edge of sole 130, where it allows the wearer a gripping surface for attachment and detachment of the invention from the underlying sandal. A plurality of friction bumps 170 emanate from the underside of sole 130, where they will contact the upper side of the sole of the underlying sandal to prevent slippage.

Figure 3:
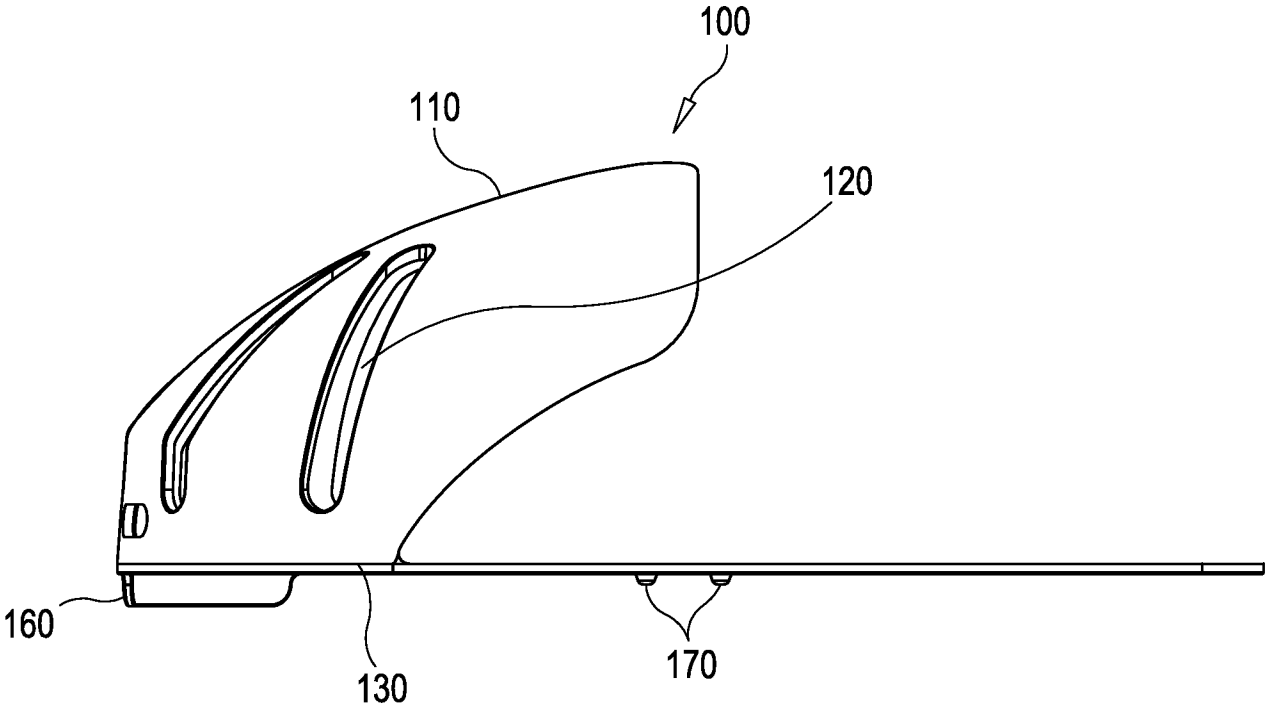
FIG. 3 is a line drawing evidencing a side view of the first embodiment of the toe cover, from the perspective of the outer edge of the foot.

FIG. 3 is a line drawing evidencing an outside-in view of the enablement of pedicure protective system 100, as pictured in FIG. 1. In this drawing, sole component 130 extends back from the front (left) edge, and each of grasping tab 160 and friction bumps 170 extend downward therefrom. Toe cover 110 extends upward and backward from the front edge and comprises ventilation slits 120.

Figure 4:
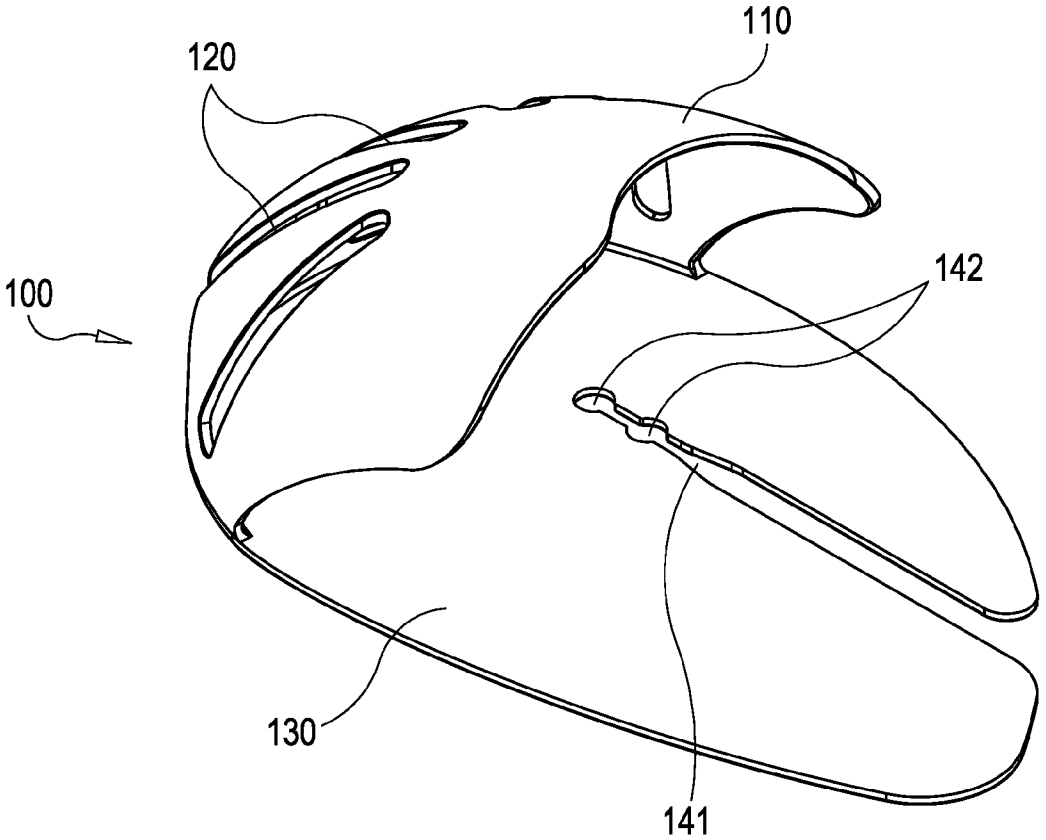
FIG. 4 is a line drawing evidencing a perspective view of the first embodiment of the toe cover.

FIG. 4 is a line drawing evidencing a perspective view of the enablement of pedicure protective system 100, as pictured in FIG. 1. In this drawing, toe cover 110 extends upward and backward from the front (left) edge and comprises ventilation slits 120. Sole component 130 extends backward from the front edge and comprises connection notch 140, which extends forward from an opening on the back (right) edge, before reaching narrowing point 141, followed by two separate insertion holes 142. Each insertion hole 142 is sized to accommodate the front portion of the strap of an underlying thong-style sandal. The presence of two insertion holes 142 allows the wearer to choose from multiple positioning options for comfort and to ensure a sufficient gap between the toe cover 110 and underlying, freshly-painted toenails.

FIG. 5 is a line drawing evidencing a bottom view of the enablement of pedicure protective system 100, as pictured in FIG. 1. This drawing evidences the underside of sole component 130, which comprises grasping tab 160 on the front (left) edge, a plurality of friction bumps 170 on either side, and connection notch 140, which extends forward from an opening on the back (right) edge, before reaching narrowing point 141, followed by two separate insertion holes 142.

Figure 6B:
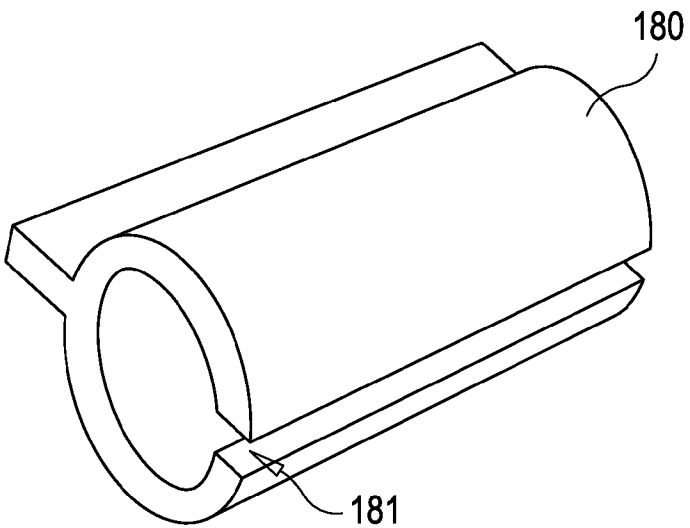
FIG. 6B is a perspective view of a clip attached to the toe cover.
Figure 6A:
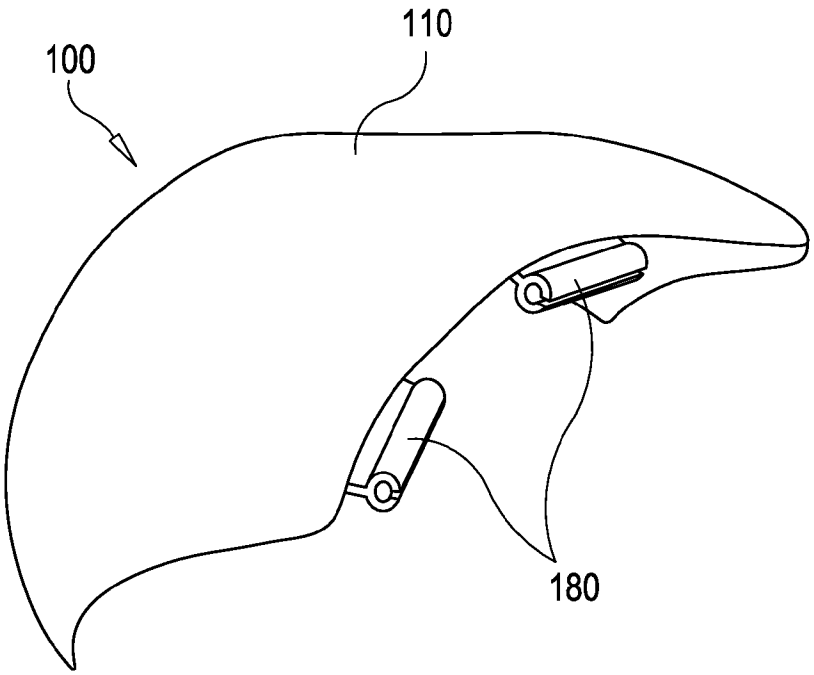
FIG. 6A is a line drawing evidencing a perspective view of a second embodiment of the toe cover.

FIG. 6*a* is a line drawing evidencing a second embodiment of pedicure protective system 100. In this drawing, toe cover 110 comprises ventilation slits 120, and attachment clips 180 are molded to the back edge of toe cover 110, wherein they can grasp the upper portion of the strap of an underlying sandal. FIG. 6*b* evidences an embodiment of a clip 180 comprising a permanent open, but narrow, slit 181 through which a footware strap may be pushed by the wearer.

Figure 7B:
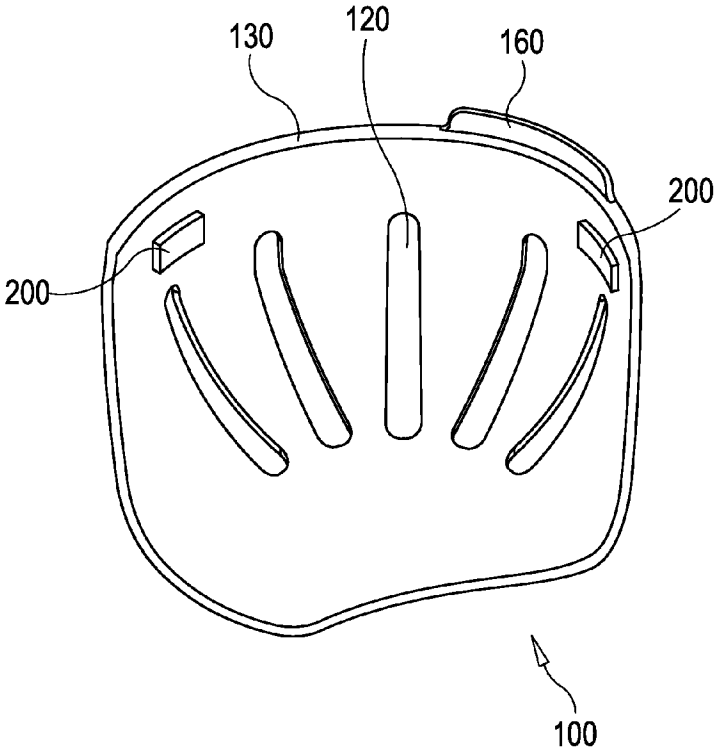
FIG. 7A is a line drawing evidencing a third embodiment of a pedicure protective system comprising an underside-view of a toe cover and FIG. 7B is a perspective view of an underlying sandal.
Figure 7A:
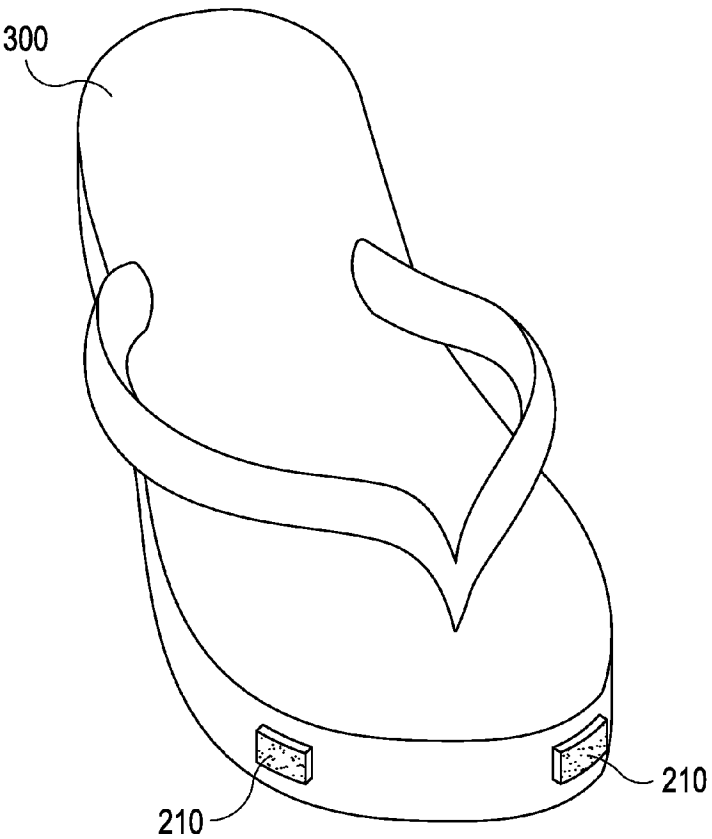

FIG. 7 is a line drawing evidencing an underside view of a third embodiment of pedicure protective system 100, together with an underlying thong-style sandal 300. In this drawing, outer ridge 190 projects downward and is sized specifically to fit around a common outline of commercially available footware so that the outer ridge overlays such footware outline. Attachment magnets 200 are adhered on the inner face of outer ridge 190, such each attachment magnet 200 overlays an attachment component 210, either comprised of a metallic tab or magnet to which attachment magnet 200 will attract, which each attachment component 210 is separately adhered to the outer rim of the sole of the underlying footware 300.

The system configuration of FIG. 7 allows for the use of alternate means of attachment between the toe cover and underlying footware, including but not limited to hook-and-loop material. Whether the attachment mechanism is magnetic, fabric or another mechanism with temporary adhesive properties, such points of attachment may be permanently affixed to the toe cover and/or footware using any commercially available and appropriate adhesive, or removably affixed using a pressure-sensitive adhesive such as, for example, the adhesives currently used with removable wall hooks.

The references recited herein are incorporated herein in their entirety, particularly as they relate to teaching the level of ordinary skill in this art and for any disclosure necessary for the commoner understanding of the subject matter of the claimed invention. It will be clear to a person of ordinary skill in the art that the above embodiments may be altered or that insubstantial changes may be made without departing from the scope of the invention. Accordingly, the scope of the invention is determined by the scope of the following claims and their equitable Equivalents.

I claim:

1. A toe cover in the shape of an enlarged shoe vamp, comprising a means of attachment to the top, front and/or outer sole of a shoe, sandal or slipper and a sole component comprising a connection notch extending forward from an opening in the back edge of the sole component.

2. The toe cover of claim 1, further comprising one or more ventilation holes.

3. The toe cover of claim 2, further comprising wherein the one or more ventilation holes are shaped as elongated vertical slits.

4. The toe cover of claim 1, further comprising wherein the material of the cover is a polymer taken from the group comprising polyethylene, polypropylene, PVC and other vinyls, PVBs and synthetic rubber.

5. The toe cover of claim 1, further wherein the forward end of the connection notch narrows, which narrow portion terminates in a lumen.

6. The toe cover of claim 1, further comprising wherein the connection notch is adjustable and comprises more than one lumen, with each lumen separated by a channel.

* * * * *